US009327301B2

(12) United States Patent
Fox

(10) Patent No.: US 9,327,301 B2
(45) Date of Patent: May 3, 2016

(54) DISPOSABLE SPRAY GUN CARTRIDGE

(76) Inventor: Jeffrey D. Fox, Nerstrand, MN (US)

( * ) Notice: Subject to any disclaimer, the term of this patent is extended or adjusted under 35 U.S.C. 154(b) by 989 days.

(21) Appl. No.: 12/920,841

(22) PCT Filed: Mar. 12, 2008

(86) PCT No.: PCT/US2008/003318

§ 371 (c)(1),
(2), (4) Date: Oct. 22, 2010

(87) PCT Pub. No.: WO2009/113980

PCT Pub. Date: Sep. 17, 2009

(65) Prior Publication Data

US 2011/0024524 A1 Feb. 3, 2011

(51) Int. Cl.

| | |
|---|---|
| ***B05B 7/02*** | (2006.01) |
| ***B05B 7/24*** | (2006.01) |
| *B05B 1/30* | (2006.01) |
| *B05B 7/12* | (2006.01) |
| *B05B 15/02* | (2006.01) |

(52) U.S. Cl.

CPC ..... *B05B 7/2408* (2013.01); *B05B 7/2478* (2013.01); *B05B 1/3046* (2013.01); *B05B 7/1209* (2013.01); *B05B 15/02* (2013.01)

(58) Field of Classification Search

CPC .. B05B 7/1209; B05B 7/2424; B05B 7/2435; B05B 1/3046; B05B 7/2408; B05B 7/2478; B05B 15/02

USPC ..... 239/290, 526, 527, 528, 375–378, 600

See application file for complete search history.

(56) References Cited

U.S. PATENT DOCUMENTS

| | | | |
|---|---|---|---|
| 40,433 | A | 10/1863 | Sees |
| 327,260 | A | 9/1885 | Hart |
| 459,432 | A | 9/1891 | Anderson |
| 459,433 | A | 9/1891 | Avery |

(Continued)

FOREIGN PATENT DOCUMENTS

| | | |
|---|---|---|
| AT | 153883 | 6/1997 |
| AT | 163577 | 3/1998 |

(Continued)

OTHER PUBLICATIONS

International Search Report published Sep. 17, 2009 for PCT/US2008/003318.

(Continued)

*Primary Examiner* — Jason Boeckmann

(74) *Attorney, Agent, or Firm* — Paul D. Bianco; Fleit Gibbons Gutman Bongini & Bianco PL

(57) ABSTRACT

A disposable cartridge assembly for use with a paint spray gun is disclosed, being made out of an inexpensive material, such as plastic, wherein the paint flows into the cartridge assembly and is sucked out of the tip of the cartridge assembly by the force of pressurized air flowing around the cartridge assembly and past the cartridge assembly fluid spray tip opening, thereby atomizing the paint, allowing for an even application of the paint onto a working surface, such as an automobile body. The inexpensive material allows the cartridge to be disposed of after use, rather than cleaned. Further, keeping the paint within the cartridge assembly and away from any inner workings of the paint spray gun reduces or eliminates the need to clean the spray gun after use.

13 Claims, 3 Drawing Sheets

(56) References Cited

U.S. PATENT DOCUMENTS 548,816 A 10/1895 Paul
552,213 A 12/1895 Troy
552,715 A 1/1896 Lugrin
563,505 A 7/1896 McCornack
581,107 A 4/1897 Emery
644,803 A 3/1900 Justi
672,012 A 4/1901 Ruper
574,880 A 5/1901 Schmidt et al.
1,662,496 A 3/1928 Forsgard
1,703,383 A 2/1929 Birkenmaier
1,703,384 A 2/1929 Birkenmaier
1,711,221 A 4/1929 Blakeslee
1,751,787 A 3/1930 Binks
2,008,381 A 7/1935 Beeg
2,049,700 A 8/1936 Gustafson
2,051,210 A 8/1936 Gustafsson
2,070,696 A 2/1937 Tracy
2,116,036 A 5/1938 Money
2,125,445 A 8/1938 Holveck
2,198,441 A 4/1940 Lobegott
2,204,599 A 6/1940 Jenkins
2,269,057 A 1/1942 Jenkins
D133,223 S 7/1942 Tammen
2,356,865 A 8/1944 Mason
2,416,856 A 3/1947 Thomsen
2,416,923 A 3/1947 Jenkins
2,557,593 A 6/1951 Bjorkman
2,557,606 A 6/1951 Liedberg
2,559,091 A 7/1951 Reasenberg
2,609,961 A 9/1952 Sapien
2,612,404 A * 9/1952 Andersson ..... 239/345
2,612,899 A 10/1952 Webb
2,646,314 A 7/1953 Peeps
2,721,004 A 10/1955 Schultz
2,844,267 A 7/1958 Petriccione
2,886,252 A 5/1959 Ehrensperger
3,090,530 A 5/1963 Peeps
3,159,472 A 12/1964 Revell
D200,594 S 3/1965 Sass
3,240,398 A 3/1966 Dalton, Jr.
D204,306 S 4/1966 Hamm
D205,760 S 9/1966 Hocutt et al.
D208,903 S 10/1967 Zadron et al.
3,344,992 A 10/1967 Norris
3,381,845 A 5/1968 MacDonald
3,417,650 A 12/1968 Varrin
3,420,106 A 1/1969 Keller et al.
3,435,683 A 4/1969 Keller et al.
3,482,781 A 12/1969 Sharpe
D217,928 S 6/1970 Felske
3,524,589 A 8/1970 Pelton, Jr.
3,527,372 A 9/1970 Manning
3,583,632 A 6/1971 Shaffer
3,622,078 A 11/1971 Gronert
3,645,562 A 2/1972 Fandetti et al.
3,656,493 A 4/1972 Black et al.
3,714,967 A 2/1973 Zupan et al.
3,746,253 A 7/1973 Walberg
3,747,850 A 7/1973 Hastings et al.
3,771,539 A 11/1973 De Santis
3,840,143 A 10/1974 Davis et al.
3,848,807 A 11/1974 Partida
3,857,511 A 12/1974 Govindan
3,870,223 A 3/1975 Wyant
3,873,023 A 3/1975 Moss et al.
4,000,915 A 1/1977 Strom
D245,048 S 7/1977 Pool
D252,097 S 6/1979 Probst et al.
4,210,263 A 7/1980 Bos
4,273,293 A 6/1981 Hastings
4,411,387 A 10/1983 Stern et al.
4,478,370 A 10/1984 Hastings
D276,472 S 11/1984 Harrison
D278,543 S 4/1985 Gintz
4,545,536 A 10/1985 Avidon
4,562,965 A 1/1986 Ihmels et al.
4,580,035 A 4/1986 Luscher
4,585,168 A 4/1986 Even et al.
4,614,300 A 9/1986 Falcoff
4,643,330 A 2/1987 Kennedy
4,653,661 A 3/1987 Buchner et al.
4,667,878 A 5/1987 Behr
4,713,257 A 12/1987 Luttermoller
D293,950 S 1/1988 Ogden et al.
4,730,753 A 3/1988 Grime
D298,372 S 11/1988 Taylor, Jr.
4,784,184 A 11/1988 Gates
4,806,736 A 2/1989 Schirico
4,826,539 A 5/1989 Harpold
4,832,232 A 5/1989 Broccoli
4,863,781 A 9/1989 Kronzer
4,877,144 A 10/1989 Thanisch
D305,057 S 12/1989 Morgan
4,887,747 A 12/1989 Ostrowsky et al.
4,901,761 A 2/1990 Taylor
4,906,151 A 3/1990 Kubis
4,917,300 A 4/1990 Gloviak et al.
4,946,075 A 8/1990 Lundback
4,964,361 A 10/1990 Aebersold
4,967,600 A 11/1990 Keller
4,969,603 A 11/1990 Norman
4,973,184 A 11/1990 La Salle
D314,421 S 2/1991 Tajima et al.
D314,588 S 2/1991 Denham
4,989,787 A 2/1991 Nikkel et al.
5,020,700 A 6/1991 Krzywdziak et al.
D318,877 S 8/1991 Miranda et al.
5,042,840 A 8/1991 Rieple et al.
D321,597 S 11/1991 Cerny
5,064,119 A 11/1991 Mellette
5,071,074 A 12/1991 Lind
5,074,334 A 12/1991 Onodera
5,078,323 A 1/1992 Frank
5,080,285 A 1/1992 Toth
5,088,648 A 2/1992 Schmon
5,090,623 A 2/1992 Burns et al.
5,102,045 A 4/1992 Diana
5,119,992 A 6/1992 Grime
5,125,391 A 6/1992 Srivastava et al.
5,135,124 A 8/1992 Wobser
5,135,172 A * 8/1992 Toth ..... 239/297
5,143,102 A 9/1992 Blaul
5,165,605 A 11/1992 Morita et al.
5,170,941 A 12/1992 Morita et al.
5,190,219 A 3/1993 Copp, Jr.
5,191,797 A 3/1993 Smith
5,228,488 A 7/1993 Fletcher
5,232,299 A 8/1993 Hiss
5,236,128 A 8/1993 Morita et al.
5,249,746 A 10/1993 Kaneko et al.
5,289,974 A 3/1994 Grime et al.
5,322,221 A 6/1994 Anderson
5,325,473 A 6/1994 Monroe et al.
5,332,156 A 7/1994 Wheeler
5,333,506 A 8/1994 Smith et al.
5,333,908 A 8/1994 Dorney et al.
5,344,078 A 9/1994 Fritz et al.
5,367,148 A 11/1994 Storch et al.
D353,836 S 12/1994 Carvelli et al.
5,381,962 A 1/1995 Teague
5,435,491 A 7/1995 Sakuma
5,443,642 A 8/1995 Bienduga
5,456,414 A 10/1995 Burns et al.
D365,952 S 1/1996 Gagnon et al.
5,503,439 A 4/1996 LaJeunesse et al.
5,533,674 A 7/1996 Feyrer et al.
5,540,385 A 7/1996 Garlick
5,540,386 A 7/1996 Roman
5,582,350 A 12/1996 Kosmyna et al.
5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon

(56) References Cited

U.S. PATENT DOCUMENTS

D380,301 S 7/1997 Kogutt
5,655,714 A 8/1997 Kieffer et al.
5,662,444 A 9/1997 Schmidt, Jr.
5,695,125 A 12/1997 Kumar
5,704,381 A 1/1998 Millan et al.
5,718,767 A 2/1998 Crum et al.
D391,403 S 3/1998 Josephs
RE35,769 E 4/1998 Grime et al.
5,762,228 A 6/1998 Morgan et al.
5,803,360 A 9/1998 Spitznagel
5,803,367 A * 9/1998 Heard et al. ..... 239/296
5,816,501 A 10/1998 LoPresti et al.
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Edo
5,874,680 A 2/1999 Moore
5,884,006 A 3/1999 Frohlich et al.
D409,719 S 5/1999 Kaneko
5,941,461 A 8/1999 Akin et al.
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
5,992,763 A 11/1999 Smith et al.
6,006,930 A 12/1999 Dreyer et al.
6,010,082 A 1/2000 Peterson
6,017,394 A 1/2000 Crum et al.
6,036,109 A 3/2000 DeYoung
6,039,218 A 3/2000 Beck
6,053,429 A 4/2000 Chang
6,056,213 A 5/2000 Ruta et al.
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,250,567 B1 6/2001 Lewis et al.
6,276,616 B1 8/2001 Jenkins
D448,451 S 9/2001 Turnbull et al.
6,308,991 B1 10/2001 Royer
D457,599 S 5/2002 Karwoski et al.
D459,432 S 6/2002 Schmon
D459,433 S 6/2002 Schmon
6,402,058 B2 6/2002 Kaneko et al.
6,402,062 B1 6/2002 Bending et al.
6,431,466 B1 8/2002 Kitajima
6,435,426 B1 8/2002 Copp, Jr.
6,442,276 B1 8/2002 Doljack
6,494,387 B1 12/2002 Kaneko
6,536,684 B1 3/2003 Wei
6,536,687 B1 3/2003 Navis et al.
D472,730 S 4/2003 Sparkowski
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
6,585,173 B2 7/2003 Schmon et al.
6,595,441 B2 7/2003 Petrie et al.
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,874,702 B2 * 4/2005 Turnbull ..... 239/526
6,874,708 B2 4/2005 Reetz, III
6,877,677 B2 4/2005 Schmon et al.
6,929,019 B2 8/2005 Weinmann et al.
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 9/2007 Tsutsumi et al.
D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Schmon
D573,227 S 7/2008 Mirazita et al.
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
7,533,678 B2 5/2009 Rosa
7,540,434 B2 6/2009 Gohring et al.
7,542,032 B2 6/2009 Kruse
7,568,638 B2 8/2009 Gehrung
D604,394 S 11/2009 Wang
7,614,571 B2 11/2009 Camilleri et al.
D607,086 S 12/2009 Kosaka
7,624,869 B2 12/2009 Primer
D607,972 S 1/2010 Wang
D608,858 S 1/2010 Baltz et al.
D614,731 S 4/2010 Wang
7,694,893 B2 4/2010 Zittel et al.
7,694,896 B2 4/2010 Turnbull et al.
D615,586 S 5/2010 Kudimi
D616,022 S 5/2010 Kudimi

(56) References Cited

U.S. PATENT DOCUMENTS

D616,527 S 5/2010 Anderson et al.
7,765,876 B1 8/2010 Chen
D624,668 S 9/2010 Noppe
7,810,744 B2 10/2010 Schmon et al.
7,819,341 B2 10/2010 Schmon et al.
D627,039 S 11/2010 Yu
D627,432 S 11/2010 Escoto et al.
7,823,806 B2 11/2010 Schmon
D629,623 S 12/2010 Lampe
7,913,938 B2 3/2011 Cooper
7,922,107 B2 4/2011 Fox
D637,269 S 5/2011 Wang
D638,121 S 5/2011 Villasana
D639,863 S 6/2011 Langan
D641,067 S 7/2011 Wang
D644,716 S 9/2011 Gehrung
D644,803 S 9/2011 Schmon
D645,094 S 9/2011 Langan
8,042,402 B2 10/2011 Brown et al.
D649,196 S 11/2011 Langan
8,052,071 B2 11/2011 Kruse
8,052,072 B2 * 11/2011 Kriesmair ..... 239/346
D655,347 S 3/2012 Gehrung
8,127,963 B2 3/2012 Gerson et al.
D657,276 S 4/2012 Brose
D661,742 S 6/2012 Clark
D663,960 S 7/2012 Jeronimo
8,225,892 B2 7/2012 Ben-Tzvi
8,240,579 B1 8/2012 Bennett
8,297,536 B2 10/2012 Ruda
D670,085 S 11/2012 Brookman et al.
D671,988 S 12/2012 Leipold
D672,012 S 12/2012 Brose et al.
D674,880 S 1/2013 Schmon
8,352,744 B2 1/2013 Kruse
D681,162 S 4/2013 Kruse
8,444,067 B2 5/2013 Schmon et al.
8,454,759 B2 6/2013 Selsvik
8,481,124 B2 7/2013 Nolte et al.
D689,590 S 9/2013 Brose
D689,593 S 9/2013 Schmon
D690,799 S 10/2013 Maier
D692,530 S 10/2013 Gehrung
8,616,434 B2 12/2013 Wilen
8,626,674 B2 1/2014 Whitehouse
8,642,131 B2 2/2014 Nolte et al.
8,757,182 B2 6/2014 Schmon
8,807,460 B2 8/2014 Charpie et al.
8,857,732 B2 10/2014 Brose
D720,015 S 12/2014 Kruse
8,899,501 B2 12/2014 Fox et al.
D721,785 S 1/2015 Gehrung
8,925,836 B2 1/2015 Dettlaff
D733,369 S 6/2015 Tschan
D733,453 S 7/2015 Tschan
D734,571 S 7/2015 Tschan
9,073,068 B2 7/2015 Krayer et al.
D737,126 S 8/2015 Tschan
D740,393 S 10/2015 Gehrung
2001/0004996 A1 6/2001 Schmon
2001/0040192 A1 11/2001 Kaneko et al.
2002/0134861 A1 9/2002 Petrie et al.
2002/0148501 A1 10/2002 Shieh
2002/0170978 A1 11/2002 Mohn
2003/0025000 A1 2/2003 Schmon et al.
2003/0066218 A1 4/2003 Schweikert
2003/0121476 A1 7/2003 McIntyre et al.
2003/0127046 A1 7/2003 Zehner et al.
2003/0164408 A1 9/2003 Schmon
2003/0177979 A1 9/2003 Crum et al.
2003/0189105 A1 10/2003 Schmon
2003/0209568 A1 11/2003 Douglas et al.
2003/0213857 A1 11/2003 Schmon et al.
2003/0218596 A1 11/2003 Eschler
2003/0230636 A1 12/2003 Rogers
2004/0046051 A1 3/2004 Santa Cruz et al.
2004/0050432 A1 3/2004 Breda
2004/0104194 A1 6/2004 Dennison
2004/0129738 A1 7/2004 Stukas
2004/0140373 A1 7/2004 Joseph et al.
2004/0155063 A1 8/2004 Hofeldt
2004/0177890 A1 9/2004 Weinmann
2004/0191406 A1 9/2004 Crum et al.
2004/0217201 A1 11/2004 Ruda
2004/0233223 A1 11/2004 Schkolne et al.
2004/0245208 A1 12/2004 Dennison
2005/0056613 A1 3/2005 King
2005/0082249 A1 4/2005 King
2005/0127201 A1 6/2005 Matsumoto
2005/0145723 A1 7/2005 Blette et al.
2005/0145724 A1 7/2005 Blette et al.
2005/0178854 A1 8/2005 Dodd
2005/0220943 A1 10/2005 Abrams et al.
2005/0248148 A1 11/2005 Schenck et al.
2005/0252993 A1 11/2005 Rogers
2005/0252994 A1 11/2005 Rogers
2005/0268949 A1 12/2005 Rosa
2005/0284963 A1 12/2005 Reedy
2006/0000927 A1 1/2006 Ruda
2006/0007123 A1 1/2006 Wilson et al.
2006/0043216 A1 * 3/2006 Robinson ..... 239/296
2006/0048803 A1 3/2006 Jessup et al.
2006/0081060 A1 4/2006 Forster
2006/0113409 A1 6/2006 Camilleri et al.
2006/0118661 A1 * 6/2006 Hartle et al. ..... 239/691
2006/0171771 A1 8/2006 Kruse
2006/0192377 A1 8/2006 Bauer et al.
2006/0196891 A1 9/2006 Gerson et al.
2007/0029788 A1 2/2007 Adler
2007/0055883 A1 3/2007 Kruse
2007/0131795 A1 6/2007 Abbate et al.
2007/0158349 A1 7/2007 Schmon et al.
2007/0205305 A1 9/2007 Vagedes
2007/0221754 A1 9/2007 Gehrung
2007/0252378 A1 11/2007 Chambers
2008/0011879 A1 1/2008 Gerson et al.
2008/0019789 A1 1/2008 Dunaway et al.
2008/0029619 A1 2/2008 Gohring et al.
2008/0128533 A1 6/2008 Gehrung
2008/0179763 A1 7/2008 Schmon et al.
2008/0251977 A1 10/2008 Naruse et al.
2008/0264892 A1 10/2008 Nozawa
2008/0272213 A1 11/2008 Ting
2008/0296410 A1 12/2008 Carey et al.
2009/0014557 A1 1/2009 Schmon et al.
2009/0026290 A1 1/2009 Fox
2009/0045623 A1 2/2009 Schmon
2009/0072050 A1 3/2009 Ruda
2009/0078789 A1 3/2009 Kruse
2009/0078790 A1 3/2009 Camilleri et al.
2009/0143745 A1 6/2009 Langan et al.
2009/0183516 A1 7/2009 Appler et al.
2009/0235864 A1 9/2009 Khoury et al.
2009/0266915 A1 10/2009 Fedorov
2010/0021646 A1 1/2010 Nolte et al.
2010/0059533 A1 3/2010 Unger et al.
2010/0084493 A1 4/2010 Troudt
2010/0108783 A1 5/2010 Joseph et al.
2010/0126541 A1 5/2010 Schmon
2010/0206963 A1 8/2010 Huang
2011/0024524 A1 2/2011 Fox
2011/0121103 A1 5/2011 Carleton et al.
2011/0125607 A1 5/2011 Wilen
2011/0127767 A1 6/2011 Wicks et al.
2011/0168811 A1 7/2011 Fox et al.
2011/0174901 A1 7/2011 Dettlaff et al.
2012/0012671 A1 1/2012 Brose et al.
2012/0097762 A1 4/2012 Gehrung et al.
2012/0132550 A1 5/2012 Gerson et al.
2012/0160935 A1 6/2012 Krayer et al.
2013/0056556 A1 3/2013 Schmon et al.
2013/0074864 A1 3/2013 Nuzzo et al.
2013/0266734 A1 10/2013 Nolte et al.
2013/0320110 A1 12/2013 Brose et al.

(56) References Cited

U.S. PATENT DOCUMENTS

| | | | |
|---|---|---|---|
| 2014/0048627 | A1 | 2/2014 | Schmon et al. |
| 2014/0059905 | A1 | 3/2014 | Raming |
| 2014/0145003 | A1 | 5/2014 | Schmon et al. |
| 2014/0305962 | A1 | 10/2014 | Tschan |
| 2015/0165463 | A1 | 6/2015 | Gehrung |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CH | 203 668 | | 6/1939 |
| CH | 542104 | A | 9/1973 |
| CH | 676208 | | 12/1990 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102211069 | | 10/2011 |
| DE | 460381 | | 5/1928 |
| DE | 1425890 | | 11/1968 |
| DE | 2950341 | | 7/1980 |
| DE | 3016419 | | 11/1981 |
| DE | 8024829.9 | | 9/1982 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4230535 | | 3/1994 |
| DE | 4321940 | | 1/1995 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |
| DE | 19945760 | | 3/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |
| DE | 102 05 831 | | 8/2003 |
| DE | 10205831 | | 8/2003 |
| DE | 10311238 | | 10/2004 |
| DE | 10 2004 027 789 | | 2/2005 |
| DE | 29825120 | | 2/2005 |
| DE | 102004027789 | A1 | 2/2005 |
| DE | 20320781 | | 6/2005 |
| DE | 10 2004 014 646 | | 7/2005 |
| DE | 10 2004 003 438 | | 8/2005 |
| DE | 102004003439 | | 8/2005 |
| DE | 10 2004 007 733 | | 9/2005 |
| DE | 10 2004 021 298 | | 11/2005 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007039106 | | 2/2009 |
| DE | 102007052067 | | 5/2009 |
| DE | 202010012449 | | 12/2010 |
| DE | 102009053449 | | 2/2011 |
| DE | 102010060086 | | 4/2012 |
| DE | 102011106060 | | 1/2013 |
| DE | 102011118120 | | 5/2013 |
| EP | 0092392 | | 10/1983 |
| EP | 524408 | | 1/1993 |
| EP | 567325 | | 10/1993 |
| EP | 0631821 | | 1/1995 |
| EP | 0650766 | | 5/1995 |
| EP | 678334 | | 10/1995 |
| EP | 0706832 | | 4/1996 |
| EP | 0710506 | | 5/1996 |
| EP | 801002 | | 10/1997 |
| EP | 987060 | | 3/2000 |
| EP | 1081639 | | 3/2001 |
| EP | 1106262 | | 6/2001 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1563913 | | 8/2005 |
| EP | 1574262 | | 9/2005 |
| EP | 1602412 | | 12/2005 |
| EP | 1708822 | | 10/2006 |
| EP | 1708823 | | 10/2006 |
| EP | 1718415 | | 11/2006 |
| EP | 1880771 | A1 | 1/2008 |
| EP | 1902766 | A1 | 3/2008 |
| EP | 1902786 | | 3/2008 |
| EP | 1902876 | | 3/2008 |
| EP | 1930084 | | 6/2008 |
| EP | 1964616 | | 9/2008 |
| EP | 1964616 | A2 | 9/2008 |
| EP | 2027931 | | 2/2009 |
| EP | 2106298 | | 10/2009 |
| EP | 2111920 | | 10/2009 |
| EP | 2490819 | | 8/2012 |
| EP | 2576079 | | 4/2013 |
| EP | 2608890 | | 7/2013 |
| FR | 398333 | | 6/1909 |
| FR | 789762 | | 11/1935 |
| FR | 1410519 | | 9/1964 |
| FR | 2444501 | | 7/1980 |

(56) References Cited

FOREIGN PATENT DOCUMENTS

| | | | |
|---|---|---|---|
| FR | 2462200 | A1 | 2/1981 |
| FR | 2 570 140 | | 3/1986 |
| FR | 2 774 928 | | 8/1999 |
| FR | 2927824 | A1 | 8/2009 |
| GB | 190900523 | | 6/1909 |
| GB | 2 132 916 | | 7/1984 |
| GB | 2153260 | | 8/1985 |
| GB | 2372465 | | 8/2002 |
| GB | 2411235 | | 8/2005 |
| HK | 1100405 | | 6/2009 |
| HK | 1096057 | | 7/2009 |
| HK | 1125067 | | 8/2012 |
| HK | 1138533 | | 11/2012 |
| JP | S5654328 | | 5/1981 |
| JP | S57-75246 | | 5/1982 |
| JP | 58-119862 | | 5/1983 |
| JP | S5998757 | | 6/1984 |
| JP | S601722 | | 1/1985 |
| JP | H01-87805 | | 6/1989 |
| JP | H0530749 | | 4/1993 |
| JP | H05172678 | | 7/1993 |
| JP | 674850 | | 3/1994 |
| JP | H06215741 | | 8/1994 |
| JP | H08196950 | | 8/1996 |
| JP | H09117697 | | 5/1997 |
| JP | 2001259487 | | 9/2001 |
| JP | 2003042882 | | 2/2002 |
| JP | 2003088780 | | 3/2003 |
| JP | 2004017044 | | 1/2004 |
| JP | 2005138885 | | 6/2005 |
| JP | 2007516831 | | 6/2007 |
| TW | 491092 | | 6/2002 |
| TW | I220392 | | 8/2004 |
| TW | I303587 | | 12/2008 |
| TW | I309584 | | 5/2009 |
| WO | 90/08456 | | 8/1990 |
| WO | 91/16610 | | 10/1991 |
| WO | 92/07346 | | 4/1992 |
| WO | 9522409 | | 8/1995 |
| WO | 98/32539 | | 7/1998 |
| WO | 01/12337 | | 2/2001 |
| WO | 0166261 | | 9/2001 |
| WO | 01/99062 | | 12/2001 |
| WO | 02/00355 | | 1/2002 |
| WO | 0202242 | | 1/2002 |
| WO | 02/18061 | | 3/2002 |
| WO | 02/085533 | | 10/2002 |
| WO | 03/007252 | | 1/2003 |
| WO | 03/045575 | | 6/2003 |
| WO | 03/069208 | | 8/2003 |
| WO | 03069208 | A1 | 8/2003 |
| WO | 2004/037433 | | 5/2004 |
| WO | 2004/052552 | | 6/2004 |
| WO | 2005/018815 | | 3/2005 |
| WO | 2005/068220 | | 7/2005 |
| WO | 2005/070557 | | 8/2005 |
| WO | 2005/070558 | | 8/2005 |
| WO | 2005/077543 | | 8/2005 |
| WO | 2005/115631 | | 12/2005 |
| WO | 2006065850 | | 6/2006 |
| WO | 2007/128127 | | 11/2007 |
| WO | 2007133386 | A2 | 11/2007 |
| WO | 2007/149760 | A2 | 12/2007 |
| WO | 2009015260 | | 1/2009 |
| WO | 2009056424 | | 5/2009 |
| WO | 2011047876 | | 4/2011 |
| WO | 2011147555 | | 12/2011 |
| WO | 2012119664 | | 9/2012 |
| WO | 2013000524 | | 1/2013 |
| WO | 2013016474 | | 1/2013 |

OTHER PUBLICATIONS

International Preliminary Report on Patentability mailed Sep. 14, 2010 for PCT/US2008/003318, filed Mar. 12, 2008.

Written Opinion mailed Jun. 20, 2008 for PCT/US2008/003318, filed Mar. 12, 2008.

Canadian Office Action dated Nov. 21, 2012 for related application CA2741703.

Chinese Search Report dated Dec. 5, 2012 for related application CN200980135429.9.

Chinese Office Action dated Dec. 13, 2012 for related application CN200980135429.9.

German Search Report for DE 20 2008 014 389.6 completed Jul. 13, 2009.

Office Action dated Nov. 18, 2014 for U.S. Appl. No. 14/113,649.

Notice of Allowance dated Nov. 19, 2014 for U.S. Appl. No. 29/486,223.

Office Action dated Dec. 31, 2014 for U.S. Appl. No. 13/380,949.

Restriction Requirement dated Jan. 9, 2015 for Design U.S. Appl. No. 29/469,049.

Response to Office Action filed Dec. 2, 2014 for U.S. Appl. No. 29/487,679.

Notice of Allowance dated Jan. 15, 2015 for Design U.S. Appl. No. 29/490,620.

Office Action dated Jan. 14, 2015 for Design U.S. Appl. No. 29/447,887.

hercules Paint Gun Washers brochure publish date Jan. 2012, [online], [site visited Jan. 7, 2015], <http://www.herkules.us/pdfs/L00761-Hercules-Gun_Washers-4-page-brochure.pdf>.

Jetclean GUn Cleaner Terry's Auto Supply, google publish date Aug. 14, 2011, [online], [site visited Jan. 7, 2015], <http://secure.terrys.net/viewProduct.php?productID=FT.FHAZ1005>.

Restriction Requirement dated Feb. 6, 2015 for Design U.S. Appl. No. 29/486,232.

Office Action dated Mar. 30, 2015 for U.S. Appl. No. 13/698,417.

Responde to Office Action filed Apr. 14, 2015 to Office Action dated Jan. 14, 2015 for U.S. Appl. No. 29/447,887.

Response filed Jul. 20, 2015 for Office Action dated Mar. 30, 2015 for U.S. Appl. No. 13/698,417.

Notice of Allowance dated Apr. 30, 2015 for U.S. Appl. No. 29/447,887.

Chinese Office Action dated Oct. 28, 2014 and Search Report dared Oct. 15, 2014 for Chinese Application No. 2011800266029.

Australian Examination Report dated Oct. 30, 2012 for Australian Application No. 2010268870.

Notice of Allowance dated Apr. 24, 2015 for Design U.S. Appl. No. 29/486,232.

Restriction Requirement dated Jan. 22, 2015 for U.S. Appl. No. 13/698,417.

Response filed Mar. 23, 2015 to Restriction Requirement dated Jan. 22, 2015 for U.S. Appl. No. 13/698,417.

Response filed Apr. 6, 2015 to Office Action dated Feb. 6, 2015 for Design U.S. Appl. No. 29/486,232.

Response filed Mar. 31, 2015 to Office Action dated Dec. 31, 2014 for U.S. Appl. No. 13/380,949.

Japanese Office Action dated Jun. 11, 2014 for Japanese Patent Application No. 2012-518769.

Australian Examination Report dated Nov. 11, 2014 for Australian patent Application No. 2011257605.

Japanese Notice of Allowance mailed Jan. 13, 2015 for Japanese Patent Application No. 2012/518769.

Application filed Dec. 11, 2011 for U.S. Appl. No. 13/380,949.

Chinese Office Action dated Jan. 28, 2014 and Search Report dated Jan. 21, 2014 for Chinese Application No. 201080030935.4.

Search Report dated Apr. 24, 2010 for German Application No. 10 2009 032 399.6-51.

Application filed Oct. 24, 2013 for U.S. Appl. No. 14/113,649.

Response filed May 18, 2015 to Office Action dated Nov. 18, 2014 for U.S. Appl. No. 14/113,649.

Application filed Dec. 17, 2014 for U.S. Appl. No. 14/572,998.

German Search Report dated Mar. 25, 2014 for German Application No. 202013105779-7.

Application filed Nov. 16, 2012 for U.S. Appl. No. 13/698,417.

Application filed Jun. 2, 2013 for U.S. Appl. No. 13/991,285.

English translation of application filed Aug. 13, 2013 for Application filed Jun. 2, 2013 for U.S. Appl. No. 13/991,285.

(56) References Cited

OTHER PUBLICATIONS

Restriction Requirement dated May 27, 2015 for U.S. Appl. No. 13/991,285.
Application filed Jan. 29, 2015 for Design U.S. Appl. No. 29/516,073.
Application filed Jan. 29, 2015 for Design U.S. Appl. No. 29/516,082.
Application filed Mar. 3, 2015, 2015 for Design U.S. Appl. No. 29/519,198.
Final Office Action dated Jul. 20, 2015 for U.S. Appl. No. 14/113,649.
Response to Restriction Requirement filed Jul. 27, 2015 to Restriction Requirement dated May 27, 2015 for U.S. Appl. No. 13/991,285.
Application filed Jul. 31, 2015 for U.S. Appl. No. 14/815,210.
Final Office Action dated Aug. 4, 2015 for U.S. Appl. No. 13/380,949.
Notice of Allowance dated Aug. 3, 2015 for U.S. Appl. No. 29/486,232.
Design U.S. Appl. No. 29/530,038, filed Jun. 12, 2015.
Office Action dated Aug. 27, 2015 for Design U.S. Appl. No. 29/530,038.
Design U.S. Appl. No. 29/530,045, filed Jun. 12, 2015.
Office Action dated Aug. 28, 2015 for Design U.S. Appl. No. 29/530,045.
Design U.S. Appl. No. 29/530,052, filed Jun. 12, 2015.
Office Action dated Aug. 28, 2015 for Design U.S. Appl. No. 29/530,052.
U.S. Appl. No. 14/249,596, filed Apr. 10, 2014.
Restriction Requirement dated Sep. 1, 2015 for U.S. Appl. No. 14/249,596.
Response filed Oct. 6, 2015 to Notice of Non-Compliant Amendment for U.S. Appl. No. 13/698,417.
Notice of Non-Compliant Amendment dated Aug. 10, 2015 for U.S. Appl. No. 13/698,417.
Final Office Action dated Oct. 16, 2015 for U.S. Appl. No. 13/698,417.
Design U.S. Appl. No. 29/530,047, filed Jun. 12, 2015.
Office Action dated Sep. 2, 2015 Design U.S. Appl. No. 29/530,047, filed Jun. 12, 2015.
Extended European Search Report dated Apr. 17, 2015 for European Application No. 14004167.4.
Response Office Action filed Nov. 2, 2015 for U.S. Appl. No. 14/249,596.
Office Action dated Aug. 7, 2015 for U.S. Appl. No. 13/991,285.
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.
International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued agains JP Patent App. 2012-508926 on Feb. 25, 2014 with English translation.
Printout from Internet www.ehow.com explaining how to choose a spray gun and stating in item 2 "Nozzle sizes vary between about 1 mm and 2 mm.", printed Sep. 7, 2012 (Exhibit 1023 in IPR 2013-0111).
Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 2012 (Exhibit 1024 in IPR 2013-0111).
Printout from Internet of pages from brochure of Walther Pilot showing nozzle sizes for spray guns ranging from 0.3 mm to 2.5 mm, dated 2007, (Exhibit 1025 in IPR 2013-0111).
Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012 (Exhibit 1026 in IPR 2013-0111).
Printout from Internet of p. 28 from current 3Mtm brochure showing Tip/Nozzle/Air Cap Selection Guide with nozzle sizes from 0.5 mm to 3.0 mm., (Exhibit 1027 in IPR 2013-0111).
decision by EPO regarding opposition proceedings to revoke patent No. 99926841.0—2425/1108476, corresponding to '387 patent, 2012, (Exhibit 1029 in IPR 2013-0111).
SATA News Publication Dan-Am Jul.-Sep. 1996, (Exhibit 1034 in IPR 2013-0111).
SATA News Publication Dan-Am Oct.-Dec. 1996, (Exhibit 1035 in IPR 2013-0111).
SATA News Publication Dan-Am Apr.-Jun. 1998 (Exhibit 1036 in IPR 2013-0111).
Dan-Am SATA Catalog 6 for spray guns 1991 (Exhibit 1037 in IPR 2013-0111).
Dan-Am SATA Catalog 8 for spray guns 1994 (Exhibit 1038 in IPR 2013-0111).
Dan-Am Catalog 6—51pp published 1991, (Exhibit 1042 in IPR 2013-0111).
Japanese Industrial Standards B 9809 English translation, 1992 (Exhibit 1049 in IPR 2013-0111).
Japanese Industrial Standards B 9809 revised Mar. 1, 1991 (Exhibit 1050 in IPR 2013-0111).
SATA News, vol. 21, 2009 (Exhibit 2010 in IPR 2013-0111).
Collision Hub TV Document (image from video clip) printed Oct. 9, 2013 (Exhibit 2011 in IPR 2013-0111).
MyRielsMe.com document from press release printed Oct. 9, 2013 (Exhibit 2012 in IPR 2013-0111).
How to set Air pressure, Utube screenshot printed Oct. 9, 2013 (Exhibit 2013 in IPR 2013-0111).
Ohio EPA Letty to Tony Larimer, response to letter dated Aug. 2006 (Exhibit 2014 in IPR 2013-0111).
Pinahs Ben-Tzvi et al, A conceptual design . . . , Mechatrronics 17 (2007) p. 1-13 (Exhibit 2015 in IPR 2013-0111).
On line ad from Amazon.com printed Oct. 14, 2013 (Exhibit 2017 in IPR 2013-0111).
Rone et al, MEMS-Baed Microdroplet Generation with Integrated Sensing, COMSOL, 2011 (Exhibit 2018 in IPR 2013-0111).
Office Action dated Dec. 31, 2015 for U.S. Appl. No. 14/572,998 (87).

(56) References Cited

OTHER PUBLICATIONS

Response filed Dec. 21, 2015 to Office Action dated Jul. 20, 2015 for U.S. Appl. No. 14/113,649 (36).
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285 (36).

* cited by examiner

DISPOSABLE SPRAY GUN CARTRIDGE

BACKGROUND OF THE INVENTION

I. Field of the Invention

This invention relates to improvements to a hand-held spray gun, specifically designed to be used with a cartridge assembly, such as those used for applying paint, and more particularly to the disposability of the spray gun cartridge.

II. Discussion of the Prior Art

Spray guns are widely used in painting applications where even application of paint is required over fairly wide areas, such as motor vehicles when painting a vehicle following repair after an accident. Typically, in spray guns, the liquid is contained in a reservoir attached to the spray gun from which the liquid is fed to a spray nozzle. At the spray nozzle, compressed air atomizes the liquid into a spray which is then applied to the surface being painted. The liquid may be gravity fed, suction fed or even pressure fed by an air bleed line to the reservoir from the compressed air line to the spray gun.

Traditionally, paint spray guns and paint spraying equipment must be thoroughly cleaned after each use, and much time is spent properly cleaning the equipment and parts of the spray gun. Solvent costs and the disposable waste generated by cleaning the spray gun add additional expense and waste. The present invention substantially reduces, and may even eliminate, that cost and waste.

Traditional spray guns also have set fluid tip sizes or, if adjustable, must be thoroughly cleaned after each use. The present invention can be made in varying fluid tip sizes depending upon the application or painting project and do not require cleaning after use.

SUMMARY OF THE INVENTION

The present invention provides a spray gun with a disposable cartridge assembly, the cartridge assembly body being a hollow tube structure with an inner and an outer surface area, a reservoir connector, a fluid spray tip and fluid spray tip opening and a cap end opening, and further having a fluid needle, a fluid needle seal, a fluid needle washer, a fluid compression spring, an E-clip and a cap. The cartridge assembly would fit within a typical spray gun and be easily removable for disposal after its use. The cartridge assembly could also have various shapes and sizes to fit within a variety of spray guns. A reservoir would deliver liquid, such as paint, a chemical, a stain, a varnish or other sprayable liquid to the cartridge assembly through a reservoir connector and into the hollow body of the cartridge assembly. Pressurized air would flow into the spray gun, around the cartridge assembly and out the spray tip of the spray gun, thereby forcibly siphoning the liquid out of the cartridge assembly and atomizing the liquid for application onto the surface being sprayed. The reservoir holding the liquid could be attached to the cartridge assembly by the reservoir connector inlet opening, or the liquid could be delivered by tubing or some other means to the cartridge assembly. The reservoir connector inlet opening configuration would vary to match the particular type of reservoir or fluid hose from which the liquid would enter the cartridge assembly. The cartridge assembly body, fluid needle and cap could be made of a variety of inexpensive materials, such as plastic, metal, an alloy or some sturdy recycled material.

DETAILED DESCRIPTION OF THE DRAWINGS

Figure 1:
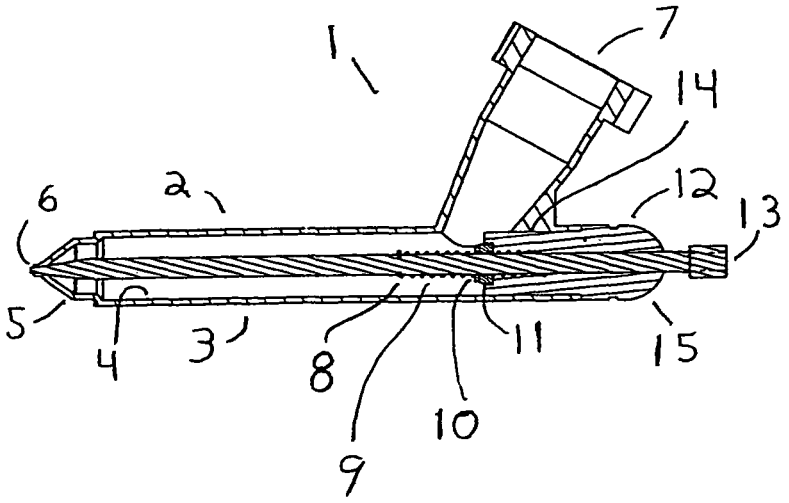
FIG. 1 is a cut-away view of the cartridge assembly.

Referring to FIG. 1, the cartridge assembly 1 is shown cut in half lengthwise. The cartridge assembly 1 comprises a body 2, an outer surface 3, an inner surface 4, a tapered fluid spray tip 5, a fluid spray tip opening 6 and a connector inlet opening 7.

Figure 2:
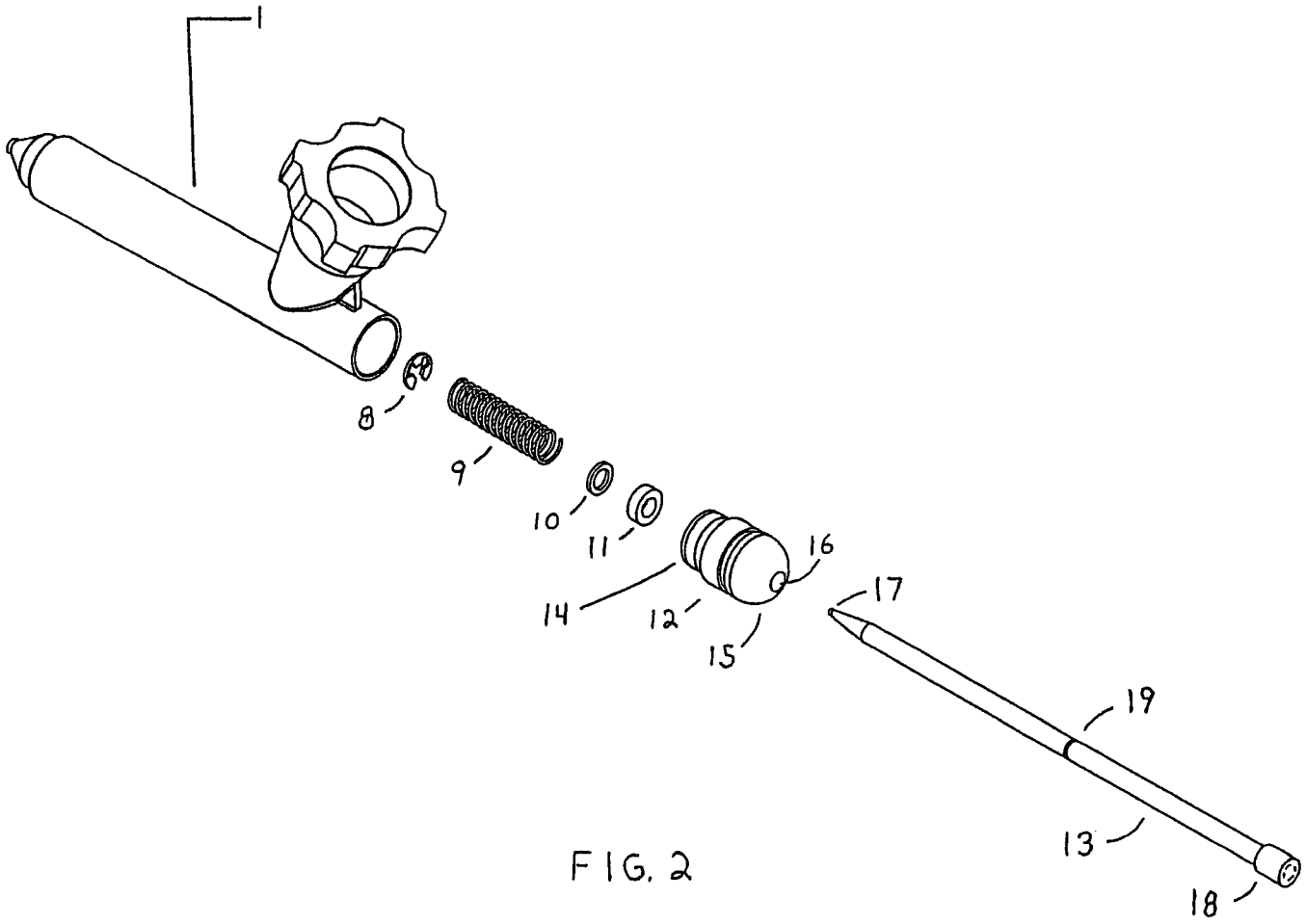
FIG. 2 is an exploded view of the cartridge assembly.

Referring now to FIG. 2, the cartridge assembly 1 is shown in exploded view, further comprising an E-clip 8, a fluid compression spring 9, a fluid needle washer 10, a fluid needle seal 11, a fluid cartridge end cap 12 and a fluid needle 13. The cartridge end cap 12 further comprises a fitting end 14 and a needle adjustment end 15. The cartridge end cap 12 further comprises a bore 16 from the fitting end 14 to the needle adjustment end 15. The bore 16 is of sufficient diameter to allow the fluid needle 13 to slide through the cartridge end cap 12.

Referring still to FIG. 2, the fluid needle 13 comprises a tapered spray tip end 17, a control end 18 and an annular groove 19 about midway between the tapered spray tip end 17 and the control end 18. The fluid needle 13 has a diameter slightly smaller than the diameter of the cartridge end cap bore 16, such that the fluid needle 17 can slide within the bore 16 through the fluid cartridge end cap 12. The control end 18 has a diameter larger than the cap bore 16 to prevent the fluid needle 13 from passing entirely through the fluid cartridge end cap 12. In operation, the fluid needle 13 slides through the fluid cartridge end cap 12, tapered spray tip end 17 first through the needle adjustment end 18, the fluid needle seal 11 is situated around the fluid needle 13 and fits snugly inside the fluid cartridge end cap 12, thereby preventing the flow of liquid out through the bore 16, after which the fluid needle washer 10 is placed on the fluid needle 13, then the fluid compression spring 9 is placed on the fluid needle 13, and the e-clip 8 is fastened around the fluid needle 13 in the annular groove 19, thereby preventing the fluid compression spring 9 and the fluid needle washer 10 from sliding off the fluid needle 13. The fluid cartridge end cap 12 is then attached to the body 2 by inserting the fitting end 14 into the body 2 and securing the fluid end cap 12 to the body 2 with adhesive means. Friction can also hold the fluid end cap 12 onto the body 2 by having the fitting end be of sufficiently large diameter to fit snugly within the inner surface 4 of the body 2.

Referring again to FIG. 1, the cartridge assembly 1 is shown with the fluid needle 13 in its at rest position, wherein the tapered spray tip end 17 of the fluid needle 13 is seated within the fluid spray tip opening 6. While in its at rest position, no liquid can escape the cartridge assembly 1. In operation, the fluid needle 13 would be pulled out slightly from its seated position, thereby allowing liquid to escape through the fluid spray tip opening 6. A reservoir for fluid (not shown) would be attached to the reservoir connector inlet opening 7, allowing liquid to feed into the cartridge assembly 1 by means of gravity.

Figure 3:
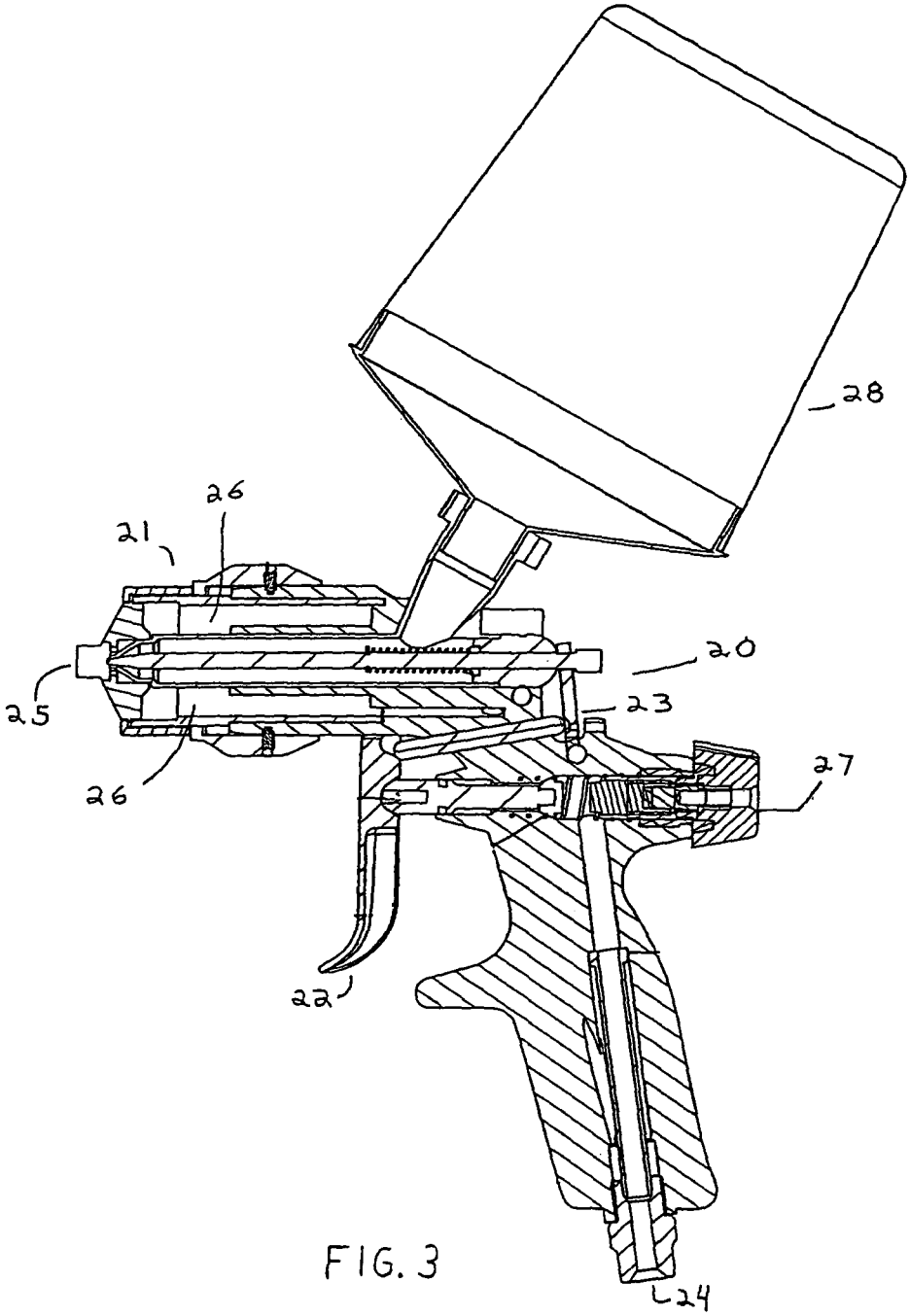
FIG. 3 is a cut-away view of a typical spray gun with the cartridge assembly contained therein.

Referring to FIG. 3, a spray gun 20 is shown with the cartridge assembly 1 in place and the reservoir 28 attached to the reservoir connector inlet opening 7 of the cartridge assembly 1. In operation, the cartridge assembly fits within the barrel 21 of the spray gun 20 with the reservoir connector inlet opening 7 protruding from the barrel 21, such that a seal is formed around the reservoir connector inlet opening 7 to prevent the flow of air out of the barrel 21 around the reservoir connector inlet opening 7. The spray gun 20 comprises a trigger 22 that controls the amount of pressurized air flowing into the barrel 21 of the spray gun 20, a lever assembly 23, an inlet air port 24 and a nozzle 25. The trigger 22 is attached to the lever assembly 23 that actuates the fluid needle 13, moving the fluid needle 13 from its at rest position, thereby unseating the tapered spray tip end 17 of the fluid needle 13 from the fluid spray tip opening 6. Pressurized air flows into the spray gun 20 through an inlet air port 24 and flows through the spray gun 20, exiting the nozzle 25. The cartridge assembly 1 fits within the barrel 21 of the spray gun 20 such that there exists a space 26 around the cartridge assembly 1, allowing the pressurized air to flow around and past the cartridge assembly 1, exiting at the nozzle 25 of the spray gun 20. As the trigger 22 is pulled, the fluid needle 13 is moved out of its seated at rest position, thereby allowing liquid fed by gravity from the reservoir 28 to the cartridge assembly 1 to escape from the fluid spray tip opening 6 and become atomized by the pressurized air flowing out of the nozzle 25 of the spray gun 20. A fluid adjuster knob 27, movably attached to the spray gun 20, limits the movement of the trigger 22, thereby controlling the amount of pressurized air entering the spray gun 20, which controls the amount of liquid escaping from the cartridge assembly 1. The amount of liquid that is sucked out of the fluid spray tip opening 6 of the cartridge assembly 1 is determined by the flow of pressurized air flowing past the fluid spray tip opening 6. The stronger the flow of pressurized air, the more liquid is sucked out of the fluid spray tip opening 6. The fluid spray tip opening 6 would have a diameter of sufficient size to suit the type of liquid being applied. Thinner liquids would require a smaller diameter fluid spray tip opening 6 while thicker liquids would require a larger diameter fluid spray tip opening 6.

No liquid touches any inner part of the spray gun 20, thus allowing for easy clean up after use. The cartridge assembly 1 and its components can be made of any number of inexpensive materials, such as plastic, thereby allowing the user to dispose of the cartridge assembly 1 after its use, thus substantially reducing or eliminating any cleaning.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A spray gun having a body, the spray gun comprising:
a device comprising:
a removable cartridge assembly sized and dimensioned to be releasably insertable within the spray gun body, the cartridge assembly including:
a spray needle having a spray end and a control end;
a one piece reservoir for receiving and containing a liquid to be sprayed, the reservoir integrally including:
a spray liquid chamber for containing a supply of liquid to be sprayed;
a spray opening to permit the liquid to be sprayed to pass out of the reservoir, and
an open end opposite the spray opening,
an inlet for admitting the liquid to be sprayed into the spray liquid chamber;
a biasing element arranged inside the spray liquid chamber and positioned to bias the needle to pass through the spray opening to control flow of the liquid to be sprayed out of the reservoir; and
a seal situated between the biasing element and the exterior of the reservoir at the open end opposite the needle opening to prevent flow of fluid out of the reservoir;
an air inlet port;
a nozzle; and
a chamber disposed within the body, the chamber sized and dimensioned to releasably admit insertion of at least a portion of the cartridge assembly,
wherein when the device is inserted into the body of the spray gun, a space is formed between the body of the spray gun and the cartridge assembly allowing pressurized air to flow around and past the cartridge assembly to exit through the nozzle together with the spray liquid from the reservoir.

2. The device of claim 1, wherein the biasing element of the removable cartridge assembly is configured to surround the needle inside of the reservoir.

3. The device of claim 2, wherein the needle further comprises an annular groove arranged between the spray end and the control end.

4. The device of claim 3, wherein the cartridge assembly further includes an e-clip fastened around the needle in the annular groove, and wherein the biasing element is a spring, the e-clip thereby positioned to connect an end of the spring to the needle.

5. The device of claim 1, wherein at least one of the reservoir and the needle are fabricated with plastic.

6. A spray gun having a body, the spray gun comprising:
a device comprising:
a removable cartridge assembly sized and dimensioned to be releasably insertable within the spray gun body the cartridge assembly including:
a spray needle having a spray end and a control end;
a one piece reservoir for receiving and containing a liquid to be sprayed, the reservoir integrally including:
a spray liquid chamber for containing a supply of liquid to be sprayed;
a spray opening to permit the liquid to be sprayed to pass out of the reservoir, and
an open end opposite the spray opening,
an inlet for admitting the liquid to be sprayed into the spray liquid chamber;
a biasing element arranged inside the spray liquid chamber and positioned to bias the needle to pass through the spray opening to control flow of the liquid to be sprayed out of the reservoir; and
a seal situated between the biasing element and the exterior of the reservoir at the open end opposite the needle opening to prevent flow of fluid out of the reservoir;
an air inlet port;
a nozzle;
a chamber disposed within the body, the chamber sized and dimensioned to releasably admit insertion of at least a portion of the cartridge assembly; and
a trigger connectable to the control end of the needle when the cartridge assembly is inserted into the gun body, the trigger thereby movable to slide the needle within the reservoir and to permit pressurized air to flow through the spray gun body around the inserted cartridge assembly.

7. A spray gun comprising:
a housing including a chamber;
a removable cartridge assembly sized and dimensioned to be releasably insertable within the chamber, the cartridge assembly including:
a spray needle having a spray end and a control end;
a one piece reservoir for receiving and containing a liquid to be sprayed, the reservoir integrally including:
a spray liquid chamber for containing a supply of liquid to be sprayed, a first opening cooperative with the spray end of the needle to permit the liquid to be sprayed to pass out of the reservoir, a second opening opposite the needle opening through which the needle control end passes, and a third opening for admitting the liquid to be sprayed into an interior of the reservoir;

a biasing element arranged inside the spray liquid chamber and positioned to bias the needle to engage the spray tip opening to control flow of the liquid to be sprayed out of the reservoir; and a seal positioned between the biasing element and an exterior of the reservoir at the second opening, the needle passing through the seal.

a trigger for controlling a position of the needle to thereby control an amount of pressurized air flowable into the spray gun; and a lever connected to the trigger and connectable to the control end of the spray needle when the cartridge assembly is inserted into the housing, wherein when the trigger is moved the needle is slid between a rest position wherein the spray end is seated within the spray tip opening, to an active position wherein the spray end is at least partially withdrawn from the spray tip opening thereby allowing liquid to be sprayed to pass through the spray tip opening.

8. The spray gun of claim 7, wherein the biasing element is a spring which is connected to the needle and surrounds the needle inside of the reservoir.

9. The spray gun of claim 8, wherein the spring is connected to the needle by an e-clip fastened around the needle in within an annular groove.

10. The spray gun of claim 7, wherein at least one of the reservoir and the needle are fabricated with plastic.

11. The spray gun of claim 7, further including an end cap releaseably positionable within the second opening and including a bore through which the control end of the needle is slideably passable, the seal connected to the bore.

12. The spray gun of claim 7, further including a seal positioned to prevent air from flowing out of the spray gun proximate the third opening.

13. A spray gun, comprising:

a housing including a chamber;

a removable cartridge assembly sized and dimensioned to be releasably insertable within the chamber, the cartridge assembly including:

a spray needle having a tapered spray end and a control end;

a one piece reservoir for receiving a liquid to be sprayed, the reservoir integrally including:

a spray liquid chamber for containing a supply of liquid to be sprayed, a first opening cooperative with the spray end of the needle to permit the liquid to be sprayed to pass out of the reservoir, a second opening at an end opposite the spray opening, through which the needle control end passes, a third opening for admitting the liquid to be sprayed into an interior of the reservoir; and a biasing element arranged inside the spray liquid chamber and connected to the needle to bias the spray end of the needle towards the first opening;

a lever connectable to the control end of the spray needle when the cartridge assembly is inserted within the housing;

a trigger connected to the lever to slide the spray needle within the reservoir when the cartridge assembly is inserted into the chamber and the control end of the spray needle is connected to the lever and the trigger is moved;

an air passage positioned to admit compressed air from a compressed air inlet to an area adjacent the first opening;

a first seal positioned to prevent air from flowing out of the spray gun past the reservoir proximate the third opening; and a second seal in fluid communication with the reservoir and positioned between the biasing element and an exterior of the reservoir at the second end, the needle passable through the second seal.

* * * * *